United States Patent [19]

Miura

[11] Patent Number: 4,756,449

[45] Date of Patent: Jul. 12, 1988

[54] APPARATUS FOR TAKING OUT BUNDLED BILLS

[75] Inventor: Yoshifumi Miura, Urawa, Japan

[73] Assignee: Laurel Bank Machines Co., Ltd., Tokyo, Japan

[21] Appl. No.: 66,660

[22] Filed: Jun. 24, 1987

[30] Foreign Application Priority Data

Jul. 8, 1986 [JP] Japan ..... 61-104519

[51] Int. Cl.[4] ..... A47F 1/12

[52] U.S. Cl. ..... 221/129; 221/130; 221/192; 221/232; 221/270; 414/277; 414/330

[58] Field of Search ..... 221/129, 130, 191, 192, 221/195, 232, 253, 254, 270; 414/277, 278, 330; 271/9

[56] References Cited

U.S. PATENT DOCUMENTS

| | | | |
|---|---|---|---|
| 1,766,297 | 6/1930 | Macke | 221/270 X |
| 1,887,197 | 11/1932 | Giles | 221/270 X |
| 2,117,906 | 5/1938 | Obermiller | 221/270 X |
| 3,750,804 | 8/1973 | Lemelson | 414/278 X |
| 4,017,004 | 4/1977 | Onoe et al. | 271/9 X |
| 4,519,523 | 5/1985 | Ohba et al. | 221/129 |
| 4,591,070 | 5/1986 | Wirstlin | 221/129 |

FOREIGN PATENT DOCUMENTS 57-81691 5/1982 Japan .

*Primary Examiner*—F. J. Bartuska

*Attorney, Agent, or Firm*—Fleit, Jacobson, Cohn & Price

[57] ABSTRACT

An apparatus for taking out bundled bills includes an elevator arranged in front of the containing boxes for containing the bundled bills, a sliding block arranged between the elevator and the containing boxes and driven up and down by a belt, a discharging block mounted on a swing shaft which is swingably mounted on the sliding block, a discharging block regulating roller for regulating the rotation of the swing block in contact with the elevator, and, having a supporting block for receiving the bundled bills having fallen and slowly guiding the bundled bills into the elevator. The present apparatus is intended to be incorporated into or combined with a machine for dispensing bundled bills and/or wrapped coins and is able to increase the amount of money dispensed per one operation by increasing the number of bundled bills contained in the elevator with the bundled bills arranged in well-ordered condition in the container and also to further increase the bills containing capacity by further effectively utilizing the space within the machine body with the elevator kept to minimized dimension as compared with bundled bills taking out mechanism of prior art.

1 Claim, 5 Drawing Sheets

APPARATUS FOR TAKING OUT BUNDLED BILLS

BACKGROUND OF THE INVENTION

The present invention relates to an apparatus for taking out bundled bills, i.e. a bundled bills taking-out apparatus which is mounted on a cash dispenser such as a bundled bills dispenser.

The bundled bills taking-out apparatus for containing classified bundled bills and dispensing them in response to instructions is often set up on or adjacent to a teller's desk in a bank so as to respond to a demand for payment of bills as a bundled unit.

One prior art of such a bundled bills taking-out apparatus is disclosed in Japanese Laid-Open Patent Publication No. 81691/1982 which was filed by the present applicant and entitled "BUNDLED BILLS DISCHARGING MACHINE".

This machine is set up on a teller's desk in a bank and is able to contain the bundled bills classified by bills kinds within a plurality of drawer type containers and discharge a necessary number of the bundled bills in classified conditions responding to an order by the teller.

However, since the bundled bills taking-out apparatus mentioned above is of a desk type and the capacity for containing the bundled bills is small, it has to be charged with the bundled bills very frequently. For such a reason, the present applicant proposed a separated bundled bills taking-out apparatus as shown in Japanese Utility Model Application No. 146500/1985.

This bundled bills taking-out apparatus includes a plurality of drawer type containers for containing the classified bundled bills vertically arranged within a machine body of a floor set type, and, an elevator movable within the machine body so as to receive a predetermined number of bundled bills from the containers and to carry them to a delivery port. Thus, this apparatus is able to effectively utilize the space within the machine body because of the single driving source usable for dispensing the bundled bills from each container to the elevator with a taking-out mechanism of the container operated by a motion of the elevator.

SUMMARY OF THE INVENTION

It is an object of the present invention to increase the amount of money dispensed per one operation by increasing the number of bundled bills contained in the elevator with the bundled bills arranged in good stacked condition in the container and also to further increase the bills containing capacity by further effectively utilizing the space within the machine body with the elevator kept to minimized dimensions.

In order to accomplish the object of the present invention, the bundled bills taking-out apparatus according to the present invention includes an elevator arranged in front of the containing boxes for containing the bundled bills, a sliding block arranged between the elevator and the containing boxes and driven up and down by a belt, a discharging block mounted on a swing shaft which is swingably mounted on the sliding block, a discharging block regulating roller for regulating the rotation of the swing block in contact with the elevator, and, a supporting block for receiving the bundled bills having fallen and slowly guiding the bundled bills into the elevator.

The rotational motion of the discharging block about the swing shaft is regulated by the discharging block regulating roller when the roller contacts the elevator situated in a specified position. Upward motion of the sliding block while keeping the discharging block in regulated condition makes the discharging block to push and discharge the bundled bills from the containing box and feed the bundled bills into the elevator after the supporting block projecting from the sliding block having temporarily supported the bundled bills.

BRIEF DESCRIPTION OF THE DRAWINGS

Other objects and advantages of the present invention will become apparent from the following detailed description of a preferred embodiment of the present invention taken in reference to the accompanying drawings in which.

DETAILED DESCRIPTION OF THE INVENTION

Figure 1:
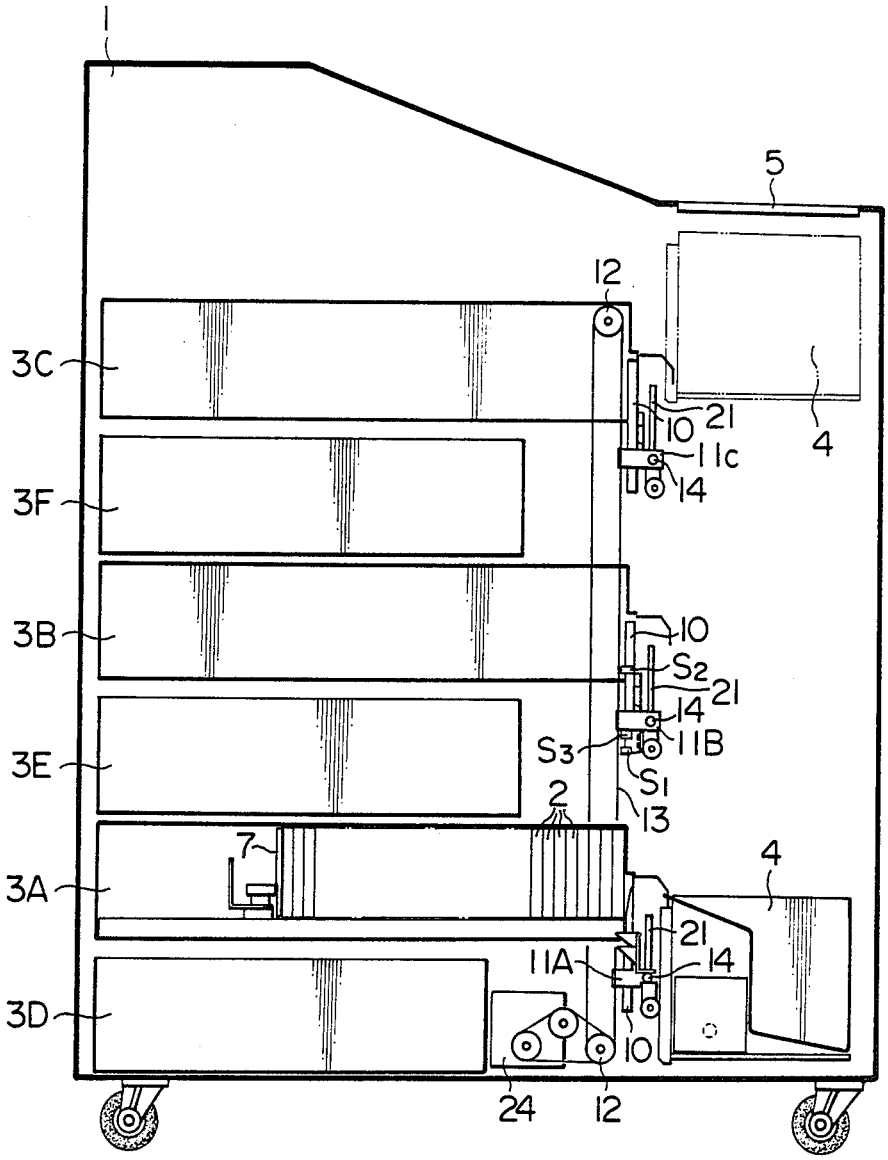
FIG. 1 is a side elevational view of one preferred embodiment of a machine for dispensing bundled bills and/or wrapped coins to which bundled bills taking-out apparatus of the present invention is incorporated.
Figure 2:
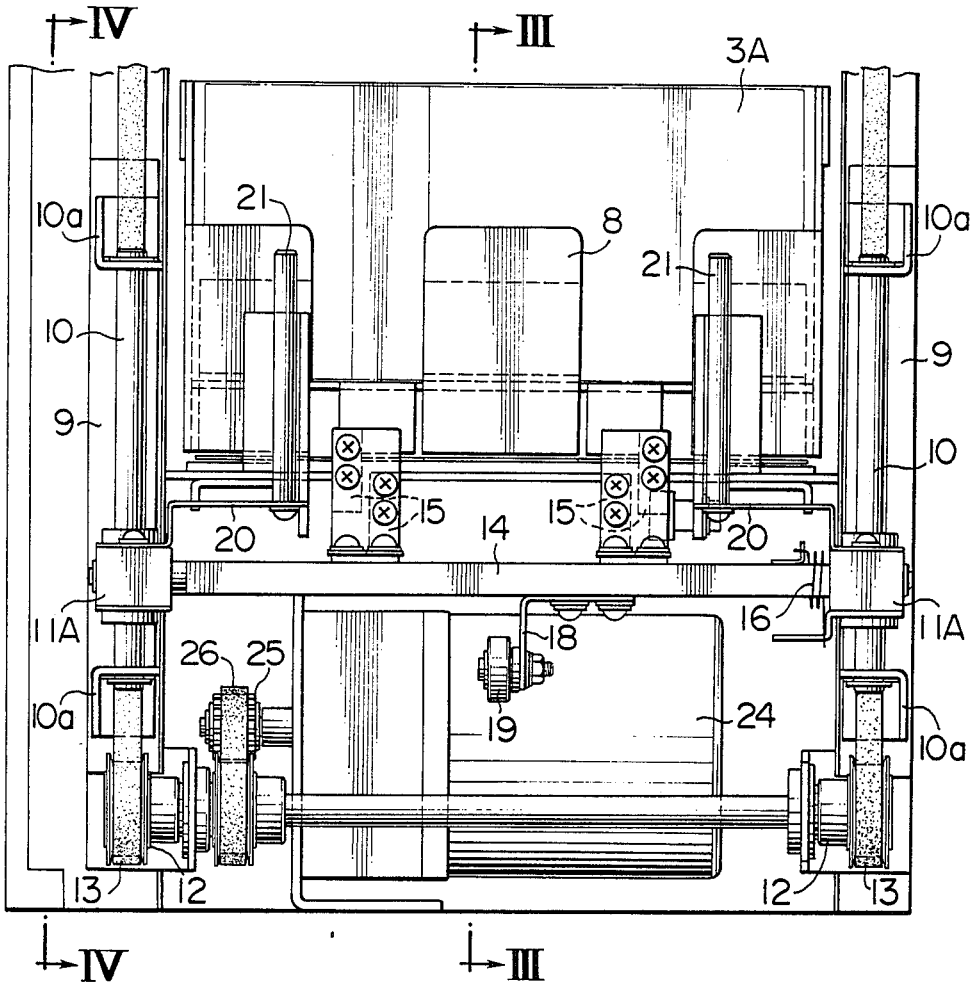
FIG. 2 is a front view of a main part of the bundled bills taking-out apparatus of FIG. 1.

Bundled bills 2 should be changed to bundled bills 2 or bills bundle 2 throughout.

In the drawings, the numeral 1 denotes a machine body within which boxes 3A~3C for containing bundled bills 2 and cassette cases (not shown) for containing wrapped coins are so mounted that they are vertically stacked in plural stages and also horizontally drawable. An elevator 4 is also mounted movably up and down within the machine body 1. Within a space 4*a* of the elevator 4, is mounted a guide-plate having a guiding surface 4*b* for guiding the bundled bills 2. The elevator 4 is able to move up and down, for example, over 11 stages and reach an uppermost stage facing to a dispensing port 5 after having received the wrapped coins and/or the bundled bills from the cassette cases vertically stacked over 10 stages and/or the containing boxes 3A~3C arranged at specified stages of the cassette cases, for example, at 1st stage, 5th stage and 9th stage.

As shown in FIG. 1, the containing boxes 3A~3C are horizontally supported by guide members 6 (FIG. 3) horizontally mounted on the machine body 1 and contain the bundled bills 2 which are separated to all bills classification (for example, in order of 1,000 yen bills, 5,000 yen bills and 10,000 yen bills from the bottom) and arranged in horizontally stacked condition. Each of the containing boxes 3A~3C is provided with a horizontally movable pushing plate 7 for urging the bundled bills horizontally. In addition, each of the containing boxes 3A~3C opens at upper face at least in a forward end region (right-hand end in FIG. 1) and provided with a front plate 8 having about ½ of the bundled bills' height (dimension in vertical direction in FIG. 3) to regulate forward motion of the bundled bills 2. Preparatory containing boxes 3D~3F for containing preparatory bundled bills and/or wrapped coins are arranged in spaces at upper and lower sides of each containing boxes 3A~3C in order to effectively utilize the space within the machine body 1 and also to expedite the charge of the bundled bills and/or wrapped coins.

Within the space in front of the containing boxes 3A~3C slide-guide shafts 10 and 10 are vertically supported by stays 9 which are also vertically arranged within the machine body 1. Each of the slide-guide shaft 10 and 10 is secured to the stay 9 through supporting brackets 10*a* and 10*a* and supports sliding blocks 11A~11C slidably in vertical direction. Adjacent to the top and bottom ends of each stay 9, there as mounted pulleys 12 and 12 on which a belt 13 is wound (a cogged belt is used in the embodiment shown to ensure a positive power transmission). Each of the sliding blocks 11A~11C is connected to the belt 13 so as to move up and down together with the motion of the belt 13.

Figure 3:
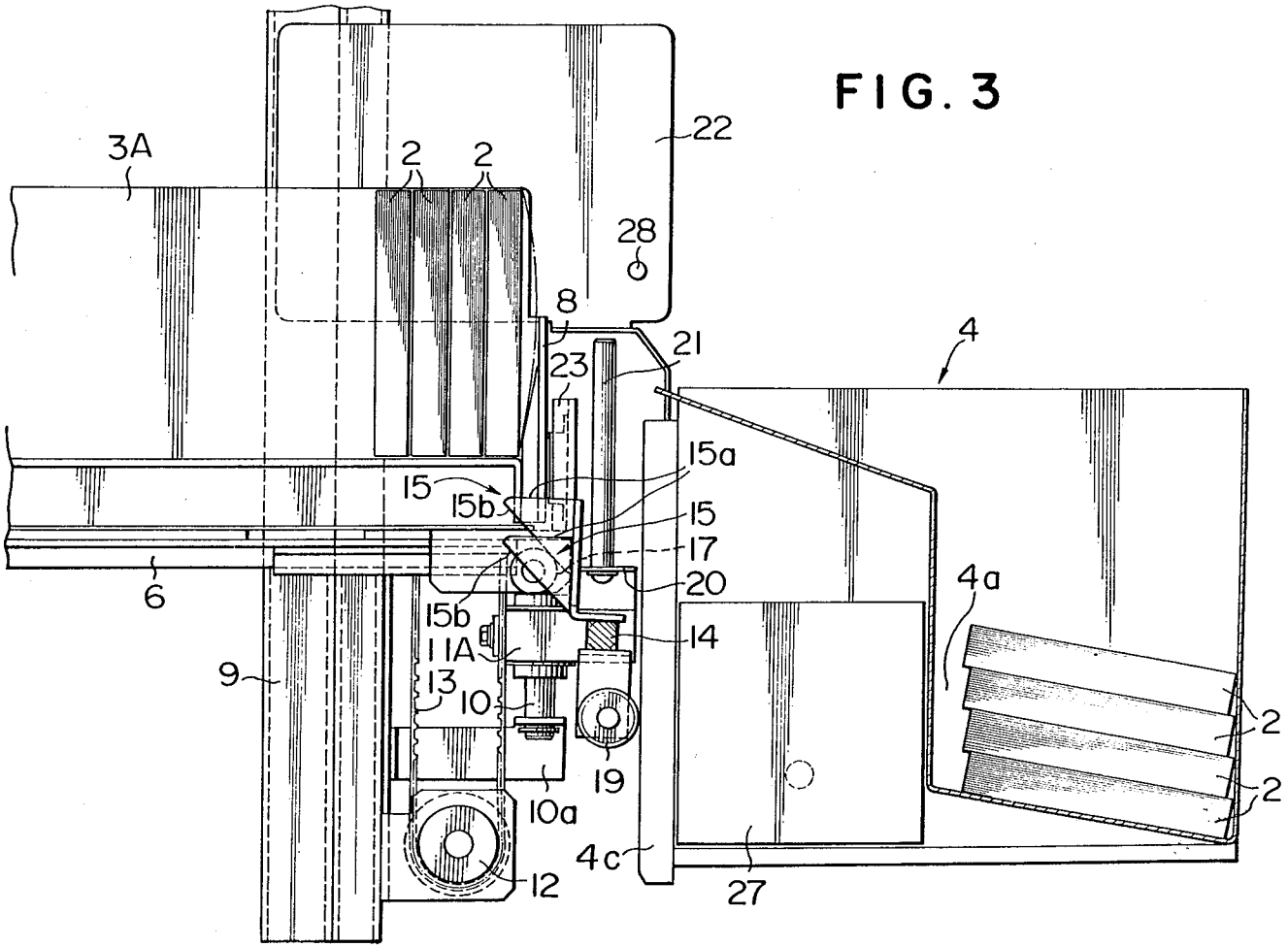
FIG. 3 is a cross-sectional view taken along line III—III of FIG. 2.

A swing shaft 14 is horizontally and rotatably mounted on each of the sliding blocks 11A~11C. Each swing shaft 14 supports a discharging block 15 for pushing the bundled bills 2 upward in abutment with the bottom surface of the bundled bills and is usually urged by a torsion spring 16 to rotate in counter-clockwise direction in FIG. 3. As shown in FIG. 3, the discharging block 15 has a bill pushing surface 15*a* for abutting against the bottom surface of the bundled bills 2 and an inclined surface 15*b* on which a discharging block reversing roller 17 mounted in front of said guide member 6 slides. The inclined surface 15*b* of the discharging block 15 is pushed upward by the discharging block reversing roller 17 when the sliding blocks 11A~11C move downward and rotates the discharging block 15 in clockwise direction in resistance to the urging force of the torsion spring 16 to keep the pushing surface 15*a* horizontal.

It is preferable to mount two discharging blocks each having different height of pushing surfaces 15*a* per one swing shaft 14.

In addition, each swing shaft 14 is also provided with a regulating arm 18 which is secured to the swing shaft 14 and rotates therewith. Mounted on the fore end of the regulating arm 18 is a discharging block regulating roller 19 which abuts against a regulating member 4*c* attached to the rear face of the elevator 4 and regulates the rotational motion of the swing shaft 14 (therefore the discharging block 15) when the elevator 4 is situated in a specified position, i.e. a position for receiving the discharged bundled bills 2 from either one of the containing boxes 3A, 3B or 3C.

Each of the sliding blocks 11A~11C is provided with horizontally extending supporting arms 20 each of which has a supporting block 21 vertically projecting therefrom and is movable up and down together with the sliding blocks 11A~11C.

The numeral 22 denotes a discharging guide for preventing falling down of a bills bundle upwardly pushed out from the containing boxes 3A~3C, 23 denotes a stopper for abutting against the front face of the containing boxes 3A~3C and securing them in place by magnet force, 24 denotes a motor for driving the pulley 12 through a pulley 25 and a belt 26, 27 denotes a motor for operating the cassette case and discharging wrapped coins therefrom, and 28 denotes a sensor such as a photo-sensor for counting the number of discharged bundled bills 2 every time the bundled bills 2 are discharged from the containing boxes 3A~3C.

The motor 24 is controlled by signals from a sensor $S_1$ for detecting retracted position of the discharging blocks 15, a discharging position detecting sensor $S_2$ and a repeating position detecting sensor $S_3$. All of which are mounted on the slide-guide shaft 10 arranged at a 2nd position from the bottom in FIG. 1.

The sensors $S_1$~$S_3$ are, for example, photo-sensors and adapted to detect the position of the sliding block 11B with these sensors switched to a ray permeable condition or a ray interrupting condition due to upward and downward motion of the sliding block 11B. Since the two sliding blocks 11A and 11c other than the sliding block 11B are mounted on the belt 13 spaced at a predetermined distance from the sliding block 11B, it is possible to detect the other two positions of the sliding blocks 11A and 11C by detecting one position of the sliding block 11B.

Then, the operation of the bundled bills taking-out apparatus of the present invention will be hereinafter explained, as will the operation of each sensor $S_1$,$S_2$ and $S_3$. In following explanations, a sign "H" denotes a ray interrupting condition and a sign "L" denotes a ray permeable condition.

(i) In a retracted condition (i.e. in a condition before a dispensing order designating amount of money or classification or money is done), the discharging block reversing roller 17 pushes the inclined surface 15*b* of the discharging block 15 and keeps the bill pushing surface 15*a* horizontal as shown in FIG. 3. On the other hand, belt 13 moves to a position whereat the pushing surface 15*a* is positioned below the under surface of the bundled bills. In this condition, the retracted position detecting sensor $S_1$ becomes "H" and the elevator 4 is on standby at the lowermost position.

(ii) When the dispensing order is done, the elevator 4 commences moving upward and stops in front of the lowermost containing box 3A. Since the discharging block 15 positioned between the stopped elevator 4 and the lowermost containing box 3A is situated at a position where the discharging block regulating roller 19 integral with the swing shaft 14 supporting the discharging block 15 contacts with the regulating member 4*c* of the elevator 4, rotation of the discharging block 15 in counterclockwise direction becomes impossible. By operating the motor 24 after the elevator 4 has been stopped, each of the sliding blocks 11A~11C is moved upward by belt 13 and the discharging block 15 supported by these blocks 11A~11C is also moved upward. (Hereinafter, the rotation of the discharging motor 24 causing upward motion of the sliding block 15 is denoted as "positive rotation" and the rotation of the motor 24 causing downward motion of the sliding block 15 is denoted as "negative rotation".)

(iii) Each of the discharging blocks is moved upward and comes into contact with the under surface of the bundled bills 2. However, as for the discharging blocks 15 supported by the sliding blocks 11B and 11C, since they move upward away from the discharging block reversing roller 17, they are rotated downward as shown by a phantom line in FIG. 4 due to the rotational moment toward counterclockwise direction of the swing shaft 14 caused by the torsional spring 16. Accordingly, neither of the sliding blocks 11B and 11C can push the bundled bills 2 and no bundled bills are discharged from the containing boxes 3B and 3C. On the contrary, since the rotation of the discharging block 15 supported by the sliding block 11A is regulated by the engagement of the roller 19 and the member 4*c* as mentioned above, the bills pushing surface 15*a* is kept horizontal and pushes the under surface of the bundled bills 2 due to the upward motion of the sliding block 11A.

Figure 4:
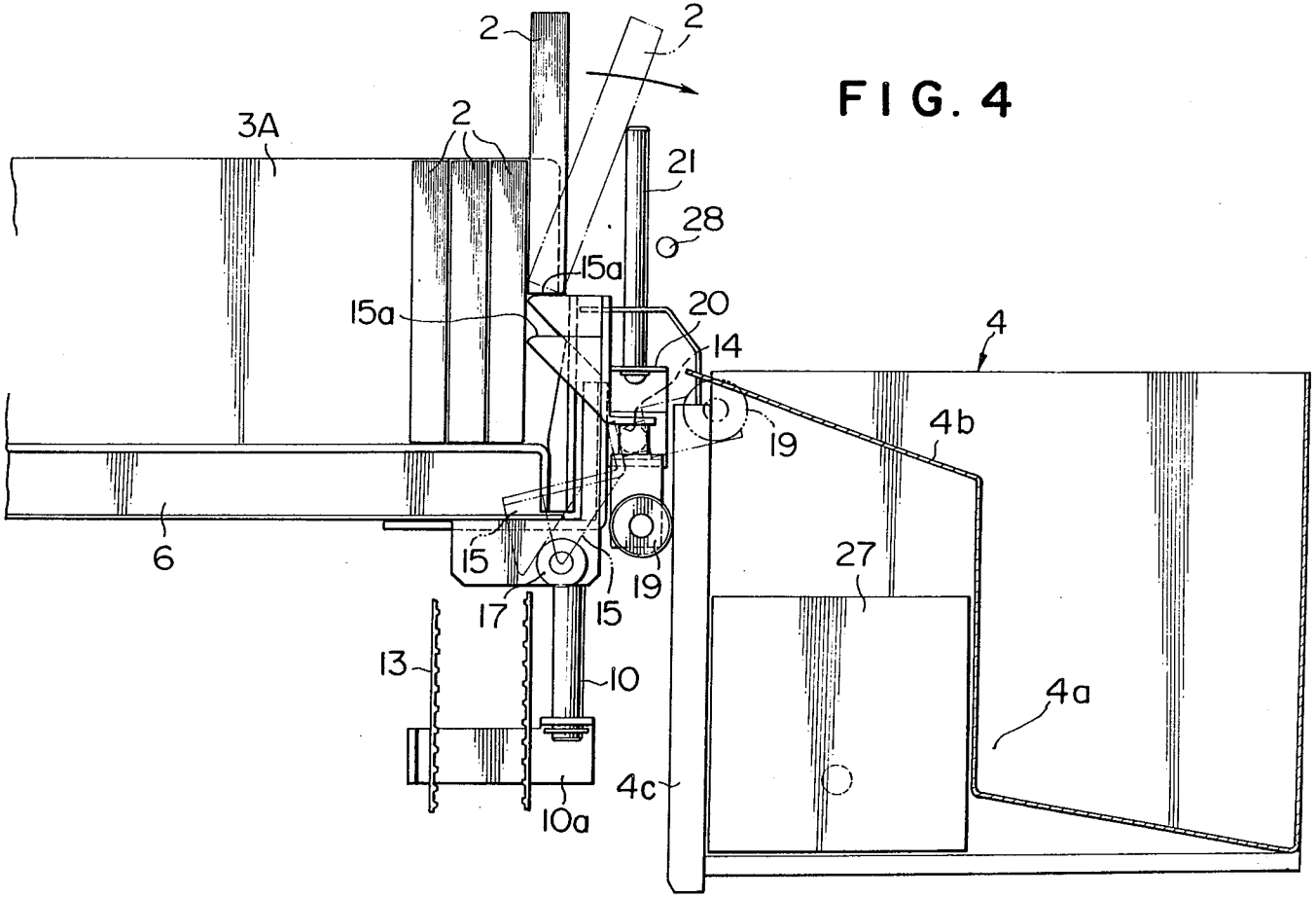
FIG. 4 is a cross-sectional view taken along line IV—IV of FIG. 2.
Figure 5:
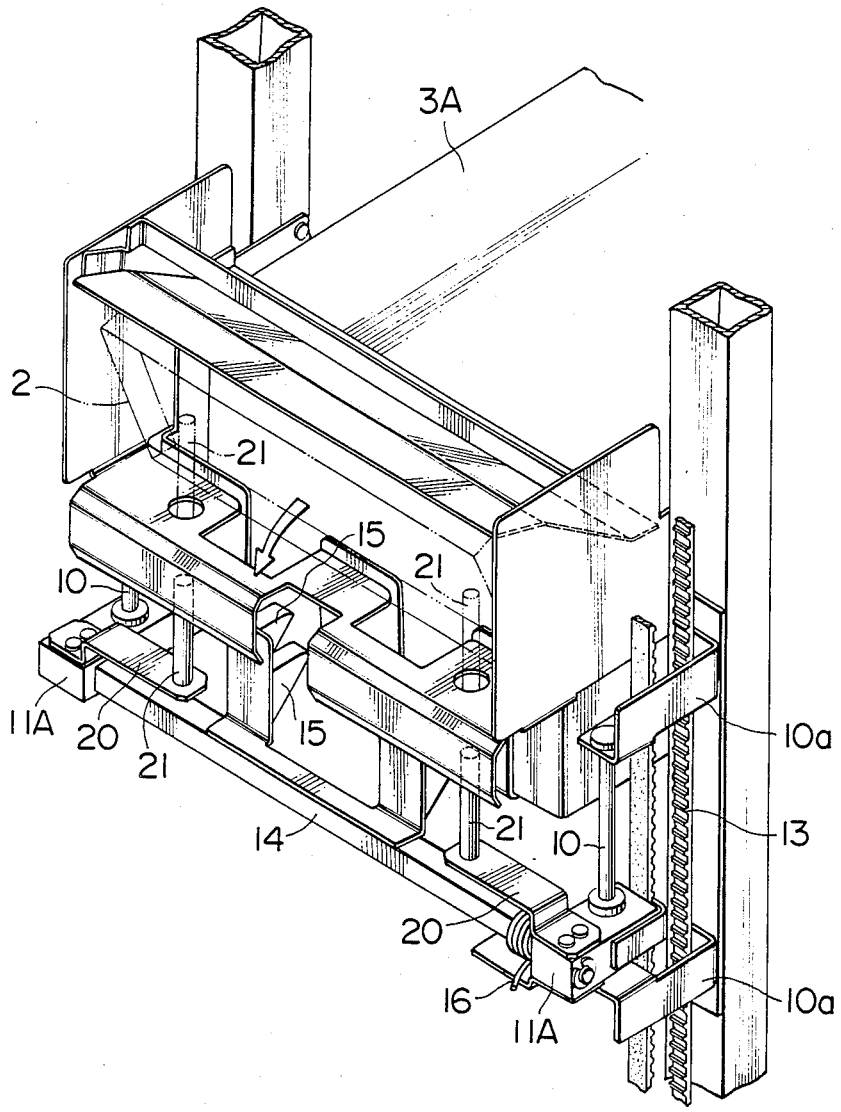
FIG. 5 is a perspective view near around a sliding block.

When the sliding block 11A is moved upward, the bundled bills 2 pushed out upward higher than the top of the front plate 8 formed integrally with the sliding block 11A is pushed out to the right in FIG. 4 by the horizontally urging force of the pushing plate 7 and then fed into the elevator 4. On the other hand, the supporting blocks 21 supported by the sliding block 11A are projected upward, interlocking with the upward motion of the sliding block 11A (i.e. upward motion of the bundled bills 2), and support the bundled bills 2 which has gotten over the front plate 8 in its inclined attitude as shown by a phantom line in FIG. 4. Then, when the sliding block 11A moves upward higher than the position at which the bundled bills 2 can be discharged, the discharging position detecting sensor $S_2$ is switched from "L" to "H", whereby the bills discharging motor 24 commences negative rotation to lower the sliding blocks 11A~11C until the retracted position detecting sensor $S_1$ is switched to "H" and then the motor 24 is stopped. Due to the downward motion of the sliding block 11A, the supporting blocks 21 also move downward, whereby the bundled bills 2 slowly fall down and are received in the elevator 4. Accordingly, it is possible to recover the elasticity of the bundled bills 2 which have been circulated and sustained damage such as fold lines while they are contained in the boxes 3A~3C in compressed condition. Also it is possible to stably and smoothly feed the bundled bills 2 into the space **4*a* of the elevator 4 with guiding the bills 2 by the guiding surface 4*b*, since the bundled bills 2 are quietly supported by the supporting block due to their slow downward motion while the bundled bills 2 are vibrated by the horizontal urging force of the pushing plate 7. The discharging blocks 15 which are mounted on the sliding blocks 11B and 11C and have fallen down during their upward motion are returned to their original attitudes where the bills pushing surfaces 15*a* become horizontal due to the engagement of their inclined surfaces 15*b* with the discharging block reversing roller 17**.

Since the discharging block 15 is so formed that it has two steps, i.e. upper and lower steps, it is possible to surely discharge the bundled bills 2 with the lower discharging block catching the bundled bills 2 which might fall from the upper discharging block if the bills have been damaged as by folding or bending.

(iv) After having taken out the wrapped coins from the cassette case positioned at the same level as the containing box 3A, simultaneously with and before or after the taking-out operation of the bundled bills 2, the elevator 4 is moved upward toward a position where a containing box or a cassette case containing the next required classification of money exists and the same operations stated above are repeated thereafter.

(v) The elevator 4 is moved toward the uppermost position after having accommodated the required number of bundled bills and/or wrapped coins therein. Thus, one cycle of the taking-out operation is completed.

In case that a plurality of bundled bills 2 of certain bills classification are required, the required number of the bundled bills 2 can be fed into the elevator 4 by negatively rotating the discharging motor 24 after the discharging position detecting sensor $S_2$ having been switched to "H" at the previously mention step (iii), then by positively rotating the discharging motor 24 after the repeating position detecting sensor $S_3$ having been switched to "H" and by repeating these operations.

MODIFIED EMBODIMENTS OF THE INVENTION (i) It is not necessary to arrange the discharging block in two steps. One step type discharging block may be adopted to simplify the structure. Otherwise, multiple step type discharging blocks may be adopted to ensure the operation of the apparatus.

(ii) It is not necessary to set the containing boxes at the 1st, 5th and 9th steps as shown in the preferred embodiment. Any other steps may be selected.

(iii) It is not necessary to adopt a rod-shaped supporting block such as shown in the preferred embodiment. Any other configuration may be appropriately adopted so long as it can support the bundled bills from the under side thereof keeping its inclined attitude and it can move up and down together with the sliding block.

EFFECTS OF THE INVENTION

As can be clearly understood from the above explanation, the bundled bills taking-out apparatus of the present invention includes: an elevator arranged in front of a plurality of containing boxes for containing bundled bills, sliding blocks interlocked each other and moved up and down by a driving belt between the elevator and the containing boxes, a discharging block secured to a swing shaft rotatably mounted on each sliding block, a discharging block regulating roller for regulating the rotation of the swing shaft with this roller contacted with the elevator, a supporting block projecting from the sliding block and moving up and down therewith. Owing to such a construction, following effects can be obtained:

(i) It is possible to slowly and smoothly guide the bundled bills to the elevator with the bundled bills supported by the supporting block when the bundled bills are pushed out from the containing box by the upwardly moved discharging block and then lowering the supporting block due to the downward motion of the sliding block.

(ii) It is possible to drive each sliding block by single power source and also to discharge the bundled bills only from a containing box existing at a position where the elevator is stopped.

(iii) It is possible to minimize the number of the sensors for detecting each position of the sliding blocks during bundled bills discharging operation and therefore to simplify the controlling mechanism, since positions of the other sliding blocks can be detected by detecting the position of one sliding block.

What is claimed is:

1. An apparatus for taking out bundled bills comprising: a plurality of boxes vertically mounted within a machine body of a cash dispenser and containing the bundled bills in horizontally stacked condition; an elevator movable up and down in front of said containing boxes; a slide-guide shaft vertically arranged between said elevator and said containing boxes; each said containing box including: a swing shaft horizontally mounted on a sliding block which is slidably mounted on said slide-guide shaft; a discharging block swingably mounted around said swing shaft for pushing out the bundled bills from said containing boxes during its upward motion together with said sliding block; said discharging block having a bills pushing surface to be contacted with the bottom surface of the bundled bills and an inclined surface on which a discharging block reversing roller slides to direct said pushing surface upward when said discharging block moves downward together with said sliding block; a regulating arm swingable together with said swing shaft and usually urged toward a direction for causing said inclined surface to abut against said discharging block reversing roller; a discharging block regulating roller mounted on said regulating arm for regulating the swing motion of said discharging block with this discharging block regulating roller abutted against a portion of said elevator when said elevator is in a specific position; and, said sliding block being provided with an upwardly projecting support block for preventing the fall of the bundled bills onto said elevator by supporting the bundled bills pushed out by said sliding block from said containing boxes until said sliding block is lowered.

* * * * *